US006113460A

United States Patent [19]

McKeown

[11] Patent Number: 6,113,460

[45] Date of Patent: Sep. 5, 2000

[54] COMBINATION WOMENS GARMENT AND BREAST SUPPORT

[76] Inventor: Steve L. McKeown, 13 Daylily, Rancho Santa Margarita, Calif. 92668

[21] Appl. No.: 09/400,571

[22] Filed: Sep. 21, 1999

[51] Int. Cl.[7] ..... A41C 3/08; A41C 3/00; A41D 5/00

[52] U.S. Cl. ..... 450/31; 450/1; 450/11; 450/30; 2/67

[58] Field of Search ..... 450/31, 1, 8–11, 450/23, 26, 80, 28, 30, 32, 33, 64, 86, 58, 53, 59, 56, 79; 2/67

[56] References Cited

U.S. PATENT DOCUMENTS

| | | | |
|---|---|---|---|
| D. 393,243 | 4/1998 | Ferguson . | |
| 933,265 | 9/1909 | Reid | 450/31 |
| 1,167,741 | 1/1916 | Clarke | 450/31 |
| 1,750,084 | 3/1930 | Abrahamson | 450/31 |
| 2,406,699 | 8/1946 | Lustig | 450/31 |
| 2,428,175 | 8/1947 | Norton | 450/31 |
| 3,527,231 | 9/1970 | Catanese et al. | 450/31 |
| 3,746,007 | 7/1973 | Hand et al. . | |
| 4,350,162 | 9/1982 | Kearton et al. | 450/31 |
| 4,372,320 | 2/1983 | Silber | 450/31 |
| 4,440,174 | 4/1984 | Cordova . | |
| 4,590,945 | 5/1986 | Fiel . | |
| 4,854,915 | 8/1989 | Luedy . | |
| 5,678,246 | 10/1997 | Cooley et al. . | |

*Primary Examiner*—Gloria M. Hale
*Attorney, Agent, or Firm*—James G. O'Neill

[57] ABSTRACT

A woman's sling-type breast support is provided and includes a pair of support straps connected at opposed ends to tapered side supporting portions at a narrow top connecting portions and lower side edge portions. The tapered side supporting portions are connected together at lower interior side edges by a connecting panel adapted to pass under and aid in supporting the breasts of a wearer without covering the outer ends of a wearer's breasts. A shirt, or similar type garment, may be incorporated with the sling-type breast support, and connected at four points to the breast support.

7 Claims, 2 Drawing Sheets

COMBINATION WOMENS GARMENT AND BREAST SUPPORT

BACKGROUND OF THE INVENTION

1. Field of the Invention

This invention relates generally to a woman's garment, and, more particularly, to a woman's top, which incorporates a sling-type device to provide support for a woman's breasts.

2. Description of Related Art

Most women wear a bra to support their breasts, particularly, when leaving their home, and when wearing a dress, blouse or other type of top. Because of the inconvenience and problems of wearing known bras, numerous devices have been proposed in which a bra is combined with a garment for convenience, or other purposes. For example, U.S. Pat. No. 4,440,174 to Cordova discloses a woman's tank top, having an outer shell, adapted to be suspended from the wearer's shoulders by a plurality of shoulder straps and an independently supported shelf bra having front and back portions secured about their top edges to the outer shell. An elastic band is provided about the lower edges of the shelf bra in order to secure it to a wearer. The front portion of the shelf bra is shirred to form two pockets to permit the front portions of the bra to conform to a wearer's breasts.

A further prior art device is shown in U.S. Pat. No. 5,678,246 to Cooley et al. The Cooley et al. patent provides a combined two-piece swimsuit with a built-in bra. The bra has a front and a back, and straps positionable over the shoulder's of a wearer with oppositely disposed arm openings and enlarged lower openings, positionable about a wearer beneath the arm openings. The bra is fabricated with two adjacent cups in the front for supporting the breasts of a full figured woman, and has a back strap with centrally disposed fasteners for putting on and taking off the bra.

Another known prior art device is set forth in U.S. Pat. No. 4,854,915 to Luedy, which comprises a post-mastectomy garment, having one or two pockets in the breast area of a facing that is attached to a bodice of the garment. A breast prosthesis may be placed in one or both of the pocket areas.

Further known devices are set forth in U.S. design Pat. No. 393,243 to Ferguson and U.S. Pat. Nos. 3,746,007 to Hand et al. and 4,590,945 to Fiel.

However, none of the known prior art patents disclose the instant invention in which a sling-type supporting element is formed to support the breasts of a user, so as to enhance the wearer's appearance, while reducing discomfort. In particular, the present invention provides women, especially those with larger breasts, a freer appearance or look, while still supporting the breasts to prevent sagging. The sling-type bra of the present invention allows a wearer to feel more attractive, more confident, comfortable and sexy. In addition, the sling-type breast support of the present invention may be incorporated in a garment, such as a T-shirt, blouse, tank top, or the like, so as to eliminate the need for wearing a separate bra. The sling-type breast support of the present invention meets a long-felt need for in the art for a comfortable, non-confining breast support, which solves known problems with existing bras, either when worn alone, or when secured or fixed in an article of clothing.

SUMMARY OF THE INVENTION

Accordingly, it is a general object of the present invention to provide an improved and simplified breast support. It is a particular object of the present invention to provide a sling-type breast support. It is another particular object of the present invention to provide an improved sling-type breast support, which may be incorporated in an article of clothing. It is still another particular object of the present invention to provide an improved breast support, which provides women with enhanced support to their breasts, while reducing the discomfort occurring when wearing a bra. It is still yet another particular object of the present invention to provide an improved breast support of a sling-type, which is a single piece and supports a woman's breast from the lower portion thereof. And, it is a still further particular object of the present invention to provide a sling-type breast support which is incorporated in a garment so as to provide a wearer with a freer braless-type of appearance, while providing adequate support to the breasts of the wearer to prevent sagging.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified sling-type breast support, generally indicated at 10.

Figure 2:
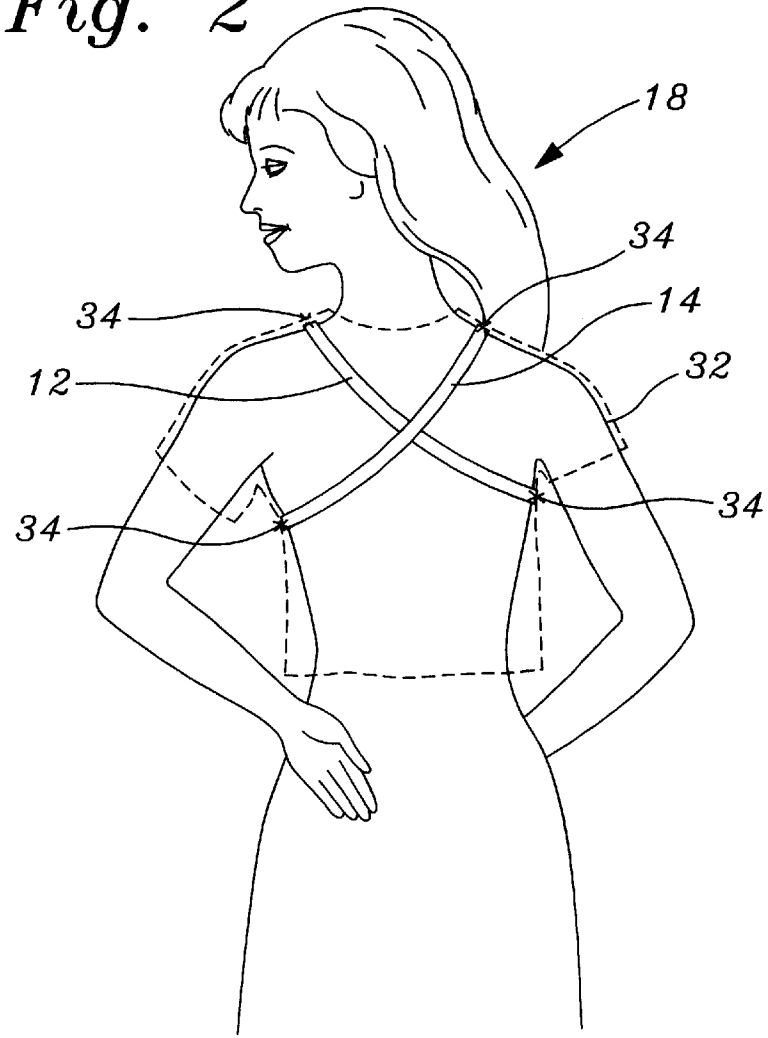
FIG. 2 is a rear elevational view of FIG. 1.
Figure 1:
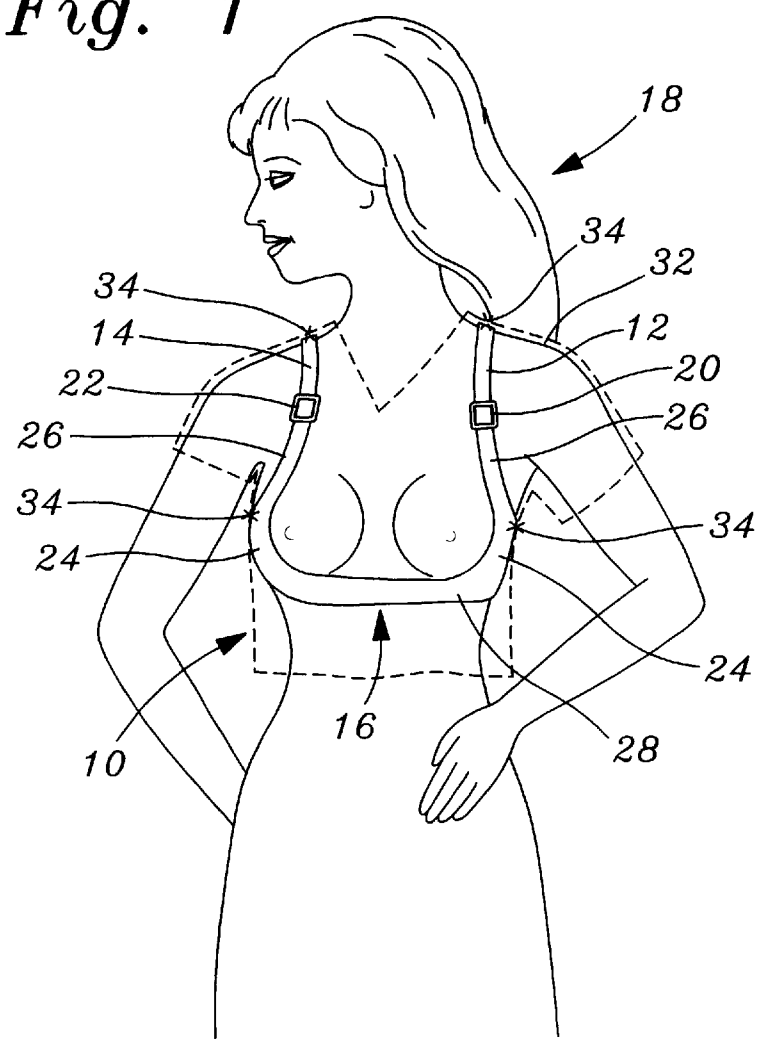
FIG. 1 is a front elevational view of a woman wearing the improved sling-type breast support of the present invention; a top is shown in broken line to indicate that the sling-type breast support of the present invention may be incorporated in an article of clothing.
Figure 3:
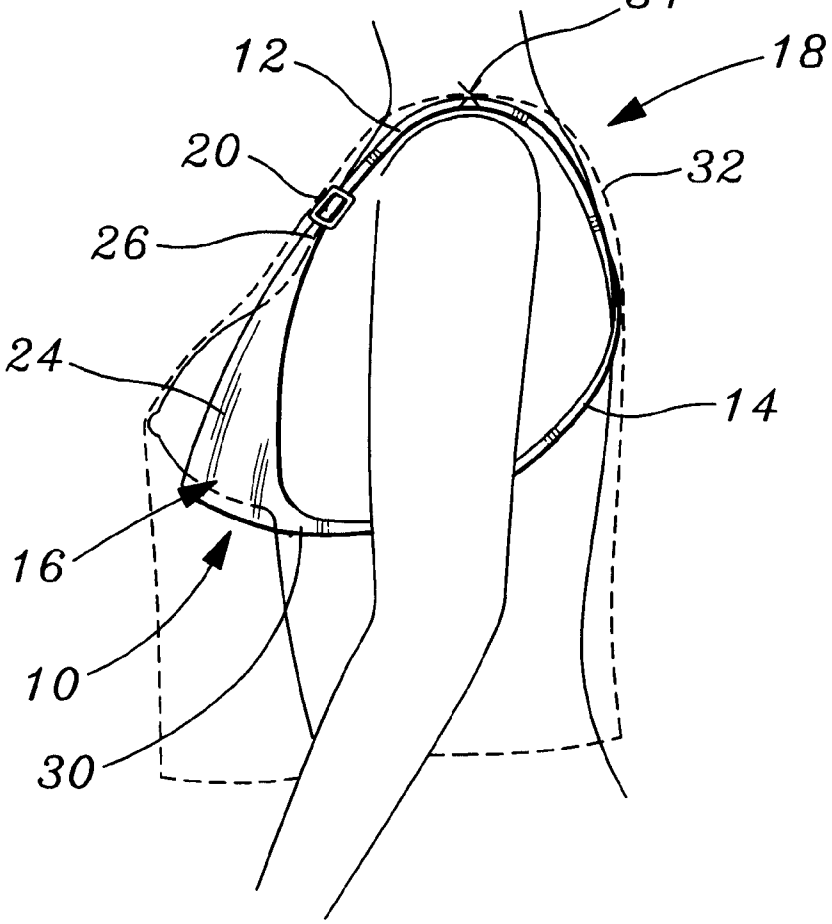
FIG. 3 is a partial side elevational view of FIG. 1.

Turning now to the drawings, there shown in FIGS. 1–3, is a sling-type breast support 10, preferably formed in one piece and having a pair of adjustable support straps 12, 14, and a sling support 16. As best shown in FIGS. 2 and 3, the support straps 12, 14 are connected at four areas or points to the support sling 16, and pass over the shoulders and under the arms of a wearer 18 to provide maximum support. The support straps 12 and 14 include adjustable buckle elements 20, 22 to enable the straps to be adjusted in length and tension for the comfort of different size wearers, in a manner well known to those skilled in the art.

As best shown in FIGS. 1 and 3, the support sling 16 has a pair of tapered side panels or portions 24 connected at upper, narrower end portions 26 thereof, to first or upper ends of the support straps 12 and 14. Lower areas of each of the tapered side panels 24 are connected across a front portion thereof by a connecting panel 28, and include lower, outer side edges areas or portions 30 (see FIG. 3), which are, in turn, connected to second or lower ends of each of the crossed support straps 12 and 14.

It, therefore, can be seen from the above-set forth description that the sling-type breast support 10 of the present invention with the tapered side panels 24 (24 and 28 are connected/formed as one piece) connected to the crossed support straps 12, 14 is easily worn by any woman. The crossed straps 12, 14 pass over the shoulders and under the arms of the wearer, and are connected to the tapered side portions 24 and connecting panel 28, which form a support sling 16 for supporting the breasts of the wearer in a comfortable, but freer, non-confining position in which the ends of the breast are uncovered, as best shown in FIGS. 1 and 3 of the drawings. The connecting panel 28 passes under the breasts of a wearer, and may be elasticized to press against the body of the wearer, as well as support the wearer's breasts.

As also shown in FIGS. 1–3 of the drawings, a garment or article of clothing, such as a top 32, may be worn over the sling-type breast support 10, and secured thereto at points 34, such as the four points shown, as by stitching, gluing, or the like. In this manner, an attractive article of clothing, incorporating the sling-type breast support of the present invention may be worn by the user, without the need of a separate bra, to enhance the appearance of the wearer, while reducing discomfort and providing a freer, sexier braless appearance, while still supporting the breasts of the wearer, in a comfortable manner to prevent sagging.

The sling-type breast support of the present invention may be made in various colors, decorative designs and sizes, and from any desired material, such as cotton, a cotton/polyester blend, spandex, etc., as well as other materials that might be provided in the future. Presently preferred embodiments include a 60% polyester/40% cotton material, while various other materials using different percentages of cotton, LYCRA and/or Spandex may be used to provide a comfortable fit in an easy-to-clean-and-use garment.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A breast support consisting of:

a single piece sling-type breast support having a pair of tapered side portions;

the pair of tapered side portions including narrow top connecting areas and lower side edges;

a connecting panel extending between lower, inner edges of the tapered side portions to form a support for a wearer's breasts; and a pair of support straps extending between the narrow top connecting portions and the lower side edges of the pair of tapered side portions to thereby support a wearer's breasts from below.

2. The breast support of claim 1 wherein the support straps are adjustable.

3. The breast support of claim 2 wherein the tapered side portions and the connecting panel are adapted to support lower and side portions of a wearer's breasts, without covering ends of the wearer's breasts.

4. The breast support of claim 3, further including an article of clothing secured at a plurality of points to the breast support so as to form a combination breast support and article of clothing.

5. A breast support consisting of a single piece sling-type breast support having a pair of tapered side supporting areas;

the pair of tapered side portions including narrow top connected areas, tapered side supporting areas and lower side edge portions;

a connecting panel extending between the tapered side supporting areas; and a pair of adjustable support straps permanently extending between the narrow top connecting areas and the lower side edge portions to form the sling-type support, which supports a wearer's breasts from below and the sides, while leaving the ends of a wearer's breasts free.

6. The breast support of claim 5, further including an article of clothing having the breast support secured at a plurality of points within the article of clothing.

7. A combination breast support and article of clothing, consisting of:

a shirt having a pair of arm openings, a neck opening and an interior surface;

a single piece sling-type breast support having a pair of adjustable shoulder straps secured within the shirt at four places;

each of the pair of adjustable shoulder straps having a first end and a second end;

each of the pair of tapered side: support portions having a narrow top connecting area connected to the first end of one of the pair of adjustable shoulder straps and a lower side edge portion connected to the second end of one of the pair of adjustable shoulder straps; and a connecting panel extending between the pair of tapered side support portions, so as to support lower and side portions of a wearer's breasts, while leaving ends of a wearer's breasts uncovered.

* * * * *